United States Patent [19]

Adachi et al.

[11] 3,975,928

[45] Aug. 24, 1976

[54] SYNCHRONIZING SIGNAL DETECTING APPARATUS FOR CIRCULAR KNITTING MACHINES

[75] Inventors: Nokihisa Adachi, Kasugai; Tetuzo Oda, Kagamigahara, both of Japan

[73] Assignee: Okuma Machinery Works, Ltd., Japan

[22] Filed: Sept. 3, 1975

[21] Appl. No.: 610,085

[52] U.S. Cl. ..... 66/154 A

[51] Int. Cl.[2] ..... D04B 15/16

[58] Field of Search ..... 66/154 A, 157, 50; 307/232; 328/155, 133, 235 N

[56] References Cited

UNITED STATES PATENTS

| | | | |
|---|---|---|---|
| 3,313,128 | 4/1967 | Schmidt et al. | 66/154 A |
| 3,313,129 | 4/1967 | Stock | 66/154 A |
| 3,588,712 | 6/1971 | Uozumi | 307/235 N |
| 3,680,331 | 8/1972 | Morat | 66/50 R |
| 3,680,331 | 8/1972 | Morat | 66/154 A |
| 3,873,853 | 3/1975 | Ahmed | 307/235 N |

*Primary Examiner*—Ronald Feldbaum
*Attorney, Agent, or Firm*—Jay L. Chaskin

[57] ABSTRACT

In order to prevent the dispersion of knitting patterns which otherwise might result from backward motion when a circular knitting machine stops, a phase condition memory unit is provided for storing the phase condition of a sine-wave signal from a needle track detector of the circular knitting machine before the sine-wave signal passes the zero level. On condition that an output is produced from the phase condition memory unit, a synchronizing signal obtained from a synchronizing signal detector is made effective.

3 Claims, 3 Drawing Figures

SYNCHRONIZING SIGNAL DETECTING APPARATUS FOR CIRCULAR KNITTING MACHINES

BACKGROUND OF THE INVENTION

1. Field of the Invention

This invention relates to synchronizing signal detecting apparatus for circular knitting machines or more in particular to a mechanical synchronizing signal detecting apparatus for circular knitting machines having an electronic pattern-forming command circuit.

2. Description of the Prior Art

In conventional circular knitting machines having an electronic pattern-forming command circuit, a control signal processed electronically in accordance with a desired pattern is applied to a needle selecting system in synchronism with the movement of the needle track of the machine. In order to detect the movement of this needle track of the machine, a needle track detector produces a sine-wave signal in synchronism with the pitches of the needle track. At the time point when this sine-wave signal passes the zero level from negative to positive side, a control signal indicating "Knit" or "Don't knit" is applied to the needle selecting system of the machine.

A minute backward motion of the machine has so far been unavoidable immediately following the stoppage thereof from a normal operating condition. In the event that the position of such a stoppage happens to be immediately after the passing of the zero level by the detected sine-wave signal, the sine-wave signal passes the same zero level again at the time of reactuation or restarting of the machine, thus erroneously producing one superfluous pulse of the synchronizing signal, with the result that a control signal displaced by one step is applied to the needle selecting system. This erroneous operation has been one of the causes for the reduction in quality due to dispersion of pattern.

SUMMARY OF THE INVENTION

Accordingly, it is an object of the present invention to improve the quality of knitting patterns by obviating the knitting error which occurs at the time of reactuation of the machine.

In other words, a phase condition memory unit is newly provided for storing the phase condition of the sine-wave signal at the time when it passes the zero level, the sine-wave signal being obtained from the needle track detector and associated with the passage of the needle along the needle track. Only when an output is produced from this phase-condition memory unit is the synchronizing signal produced from the synchronizing signal detector made effective.

DESCRIPTION OF THE PREFERRED EMBODIMENTS

Figure 1:
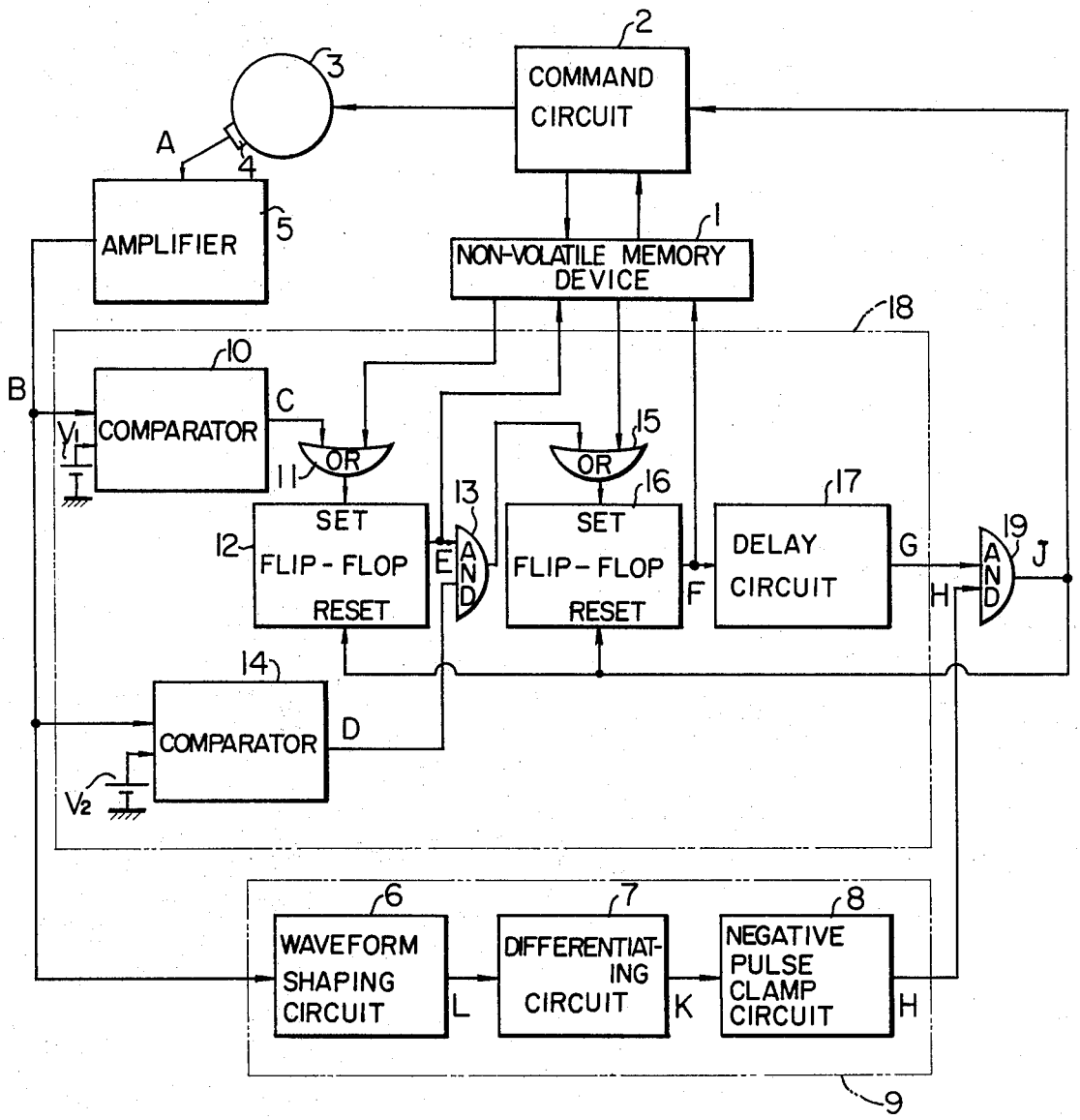
FIG. 1 is a block diagram showing an embodiment of the invention.

In FIG. 1 showing an embodiment of the invention, reference numeral 1 shows a non-volatile memory device for storing pattern signals representing desired knitting patterns and the outputs of flip-flops 12 and 16 described later, in the form of binary numbers or other codes. Numeral 2 shows a command circuit for processing a knitting pattern signal currently in use for knitting operations, among those pattern signals representing the knitting patterns stored in the non-volatile memory device 1. Numeral 3 shows a circular knitting machine having a needle-selecting system receiving the pattern signal thus processed in the command circuit 2. Numeral 4 shows a needle track detector disposed in proximity to the front surface of the needle track on the periphery of the rotating cylinder of the circular knitting machine. This needle track detector detects the movement of the needle track and produces a signal for synchronizing the processing of the pattern signal with the knitting speed of the circular knitting machine. Numeral 5 shows an amplifier for amplifying the output A produced by the needle track detector 4. Numeral 6 shows a waveform shaping circuit for converting the sine-wave signal of output B amplified by the amplifier 5 into a rectangular wave signal. Numeral 7 shows a differentiating circuit for differentiating the output L produced from the waveform shaping circuit 6, and numeral 8 shows a negative pulse clamp circuit for eliminating negative pulses from the output K of the differentiating circuit 7. The synchronizing signal detector 9 is made up of the circuits 6, 7 and 8.

In conventional apparatuses, the output H of the synchronizing signal detector 9 is used as a synchronizing signal. Since the conventional apparatuses do not employ any means for checking the above-mentioned backward motion of the machine, however, one superfluous pulse of synchronizing signal is erroneously produced depending on the position of stoppage of the machine.

Figure 2:
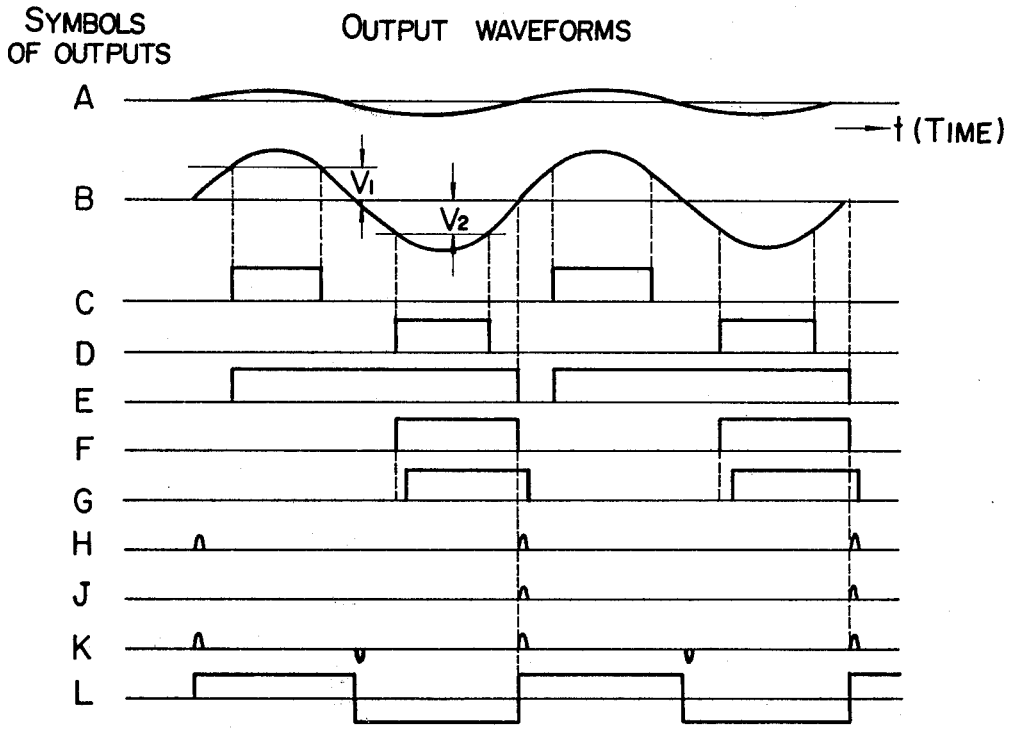
FIG. 2 shows waveforms of inputs and outputs of various circuits included in FIG. 1.
Figure 3:
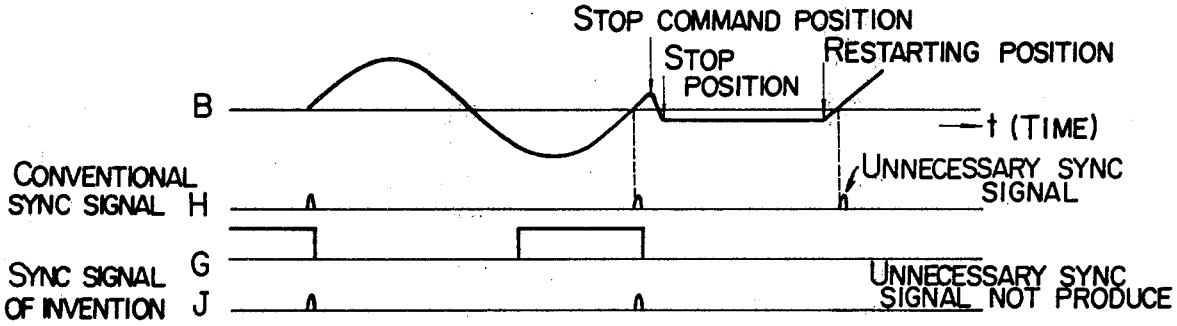
FIG. 3 is a diagram comparing the synchronizing signal (H) produced in the conventional knitting machines with the synchronizing signal (J) produced in the apparatus according to the invention.

As such checking means, the present invention employs a phase condition memory unit 18 for storing the phase condition at a point prior to the passing of the zero level by the sine-wave signal produced from the needle track detector 4. Numeral 10 shows a comparator for comparing the sine-wave signal B produced from the needle track detector 4 with a setting $V_1$ to check whether or not the signal B has passed the predetermined high level $V_1$ prior to the time point when the signal B passes the zero level. Output C of the comparator 10 is set in the flip-flop 12 through an OR circuit 11. Numeral 14 shows a similar comparator for comparing the signal B with a setting $V_2$ to check whether or not the signal B has passed the predetermined low level $V_2$. The output D of the comparator 14 is applied as one input to an AND circuit 13. The output E of the flip-flop 12 is applied as the other input to the AND circuit 13, the output of which is applied to and set in the flip-flop 16 through the OR circuit 15. Numeral 17 shows a delay circuit for delaying the output F of the flip-flop 16 slightly behind the synchronizing signal H. The output E of the flip-flop 12 and the output F of the flip-flop 16 are kept stored in the non-volatile memory device 1, so that the states of such outputs can be set again in the flip-flop 12 and 16 through the OR circuits 11 and 15 at the time of reclosing the power switch. Further, the flip-flops 12 and 16 are reset by the output J of the AND circuit 19. The foregoing is the construction of the phase condition memory unit 18. The output G of the phase condition memory unit and the output H of the synchronizing signal detector are applied to the AND circuit 19 to obtain a logical product thereof. The output J of the AND circuit 19 is applied to a command circuit 2 as a complete and correct synchronizing signal. The relation of operation between the various elements will be made apparent further by reference to the output waveforms produced therefrom as shown in FIG. 2. Next, assume that the position of stoppage of the machine causes an erroneous operation thereof, for example, that a machine stop command is issued immediately after the sine-wave signal has passed the zero level. In such a case, the output signal B from the amplifier 5 takes the waveform as shown in FIG. 3. The comparison between the synchronizing signal H in the conventional apparatuses and the synchronizing signal J produced in the apparatus according to the invention clearly shows that the conventional synchronizing signal H is produced undesirably once again at the time of the restarting of the machine, thus causing a knitting error.

In the apparatus according to the invention, by contrast, the output G of the phase condition memory unit 18 is not produced at the time of machine restarting. Therefore, by obtaining a logical product of the output G and the synchronizing signal H which is an output of the synchronizing signal detector 9, it is possible to entirely prevent an unnecessary synchronizing signal which otherwise might be generated by the backward motion of the machine at the time of stoppage thereof. In other words, erroneous generation of a synchronizing signal is eliminated thereby to prevent the knitting error at the time of machine restart. Thus the product pattern is not dispersed, making possible products always of a high quality.

We claim:

1. In a synchronizing signal detecting apparatus for the circular knitting machine comprising a memory device for storing pattern signals representing a plurality of desired knitting patterns, a command circuit for processing a pattern signal associated with the current knitting operation among said pattern signals stored in said memory device, a needle track detector for producing a sine-wave signal associated with the movement of a needle track, a synchronizing signal detector for producing a synchronizing signal at the time point when said sine-wave signal crosses the zero level, and a needle-selecting system disposed in opposition to each yarn feeder on the periphery of the cylinder of said circular knitting machine, said pattern signal associated with the current knitting operation being processed in synchronism with the knitting speed of said circular knitting machine, said needle-selecting system being impressed with said pattern signal processed as above, thus performing a pattern knitting operation; the improvement further comprising means for ascertaining that said sine-wave signal has passed a predetermined valve before crossing the zero level, said synchronizing signal being made effective when said ascertaining means produces an ascertained signal.

2. In a synchronizing signal detecting apparatus for the circular knitting machine comprising a memory device for storing pattern signals representing a plurality of desired knitting patterns, a command circuit for processing a pattern signal associated with the current knitting operation among said pattern signals stored in said memory, a needle track detector for producing a sine-wave signal associated with the movement of a needle track, a synchronizing signal detector for producing a synchronizing signal at the time point when said sine-wave signal crosses a zero level, and a needle-selecting system disposed in opposition to each yarn feeder on the periphery of the cylinder of said circular knitting machine, said pattern signal associated with the current knitting operation being processed in synchronism with the knitting speed of said circular knitting machine, said needle-selecting systen being impressed with said pattern signal processed as above, thus performing a pattern knitting operation; the improvement further comprising a phase condition memory unit including a comparator for checking whether or not said sine-wave has passed a predetermined high level $_1$ before crossing the zero level, a first flip-flop for storing the output of said comparator, a comparator for checking whether or not said sine-wave signal has passed a predetermined low level, a second flip-flop for storing the output of said comparator and the output of said first flip-flop, and a delay circuit for delaying the output of said second flip-flop, the output of said synchronizing signal detector being made effective only when an output is produced from said phase condition memory unit.

3. An apparatus according to claim 1 wherein said ascertaining means comprises a comparator for checking whether or not said sine wave signal has passed a predetermined signal level and means for receiving an output from the comparator and generating a signal to make the output of the synchronizing detector effective.

* * * * *